US011380976B2

(12) United States Patent
Verlinden et al.

(10) Patent No.: US 11,380,976 B2
(45) Date of Patent: Jul. 5, 2022

(54) OVERBOARD TRACKING PATCH

(71) Applicant: Pallas LLC, Clarksburg, MD (US)

(72) Inventors: Christopher Verlinden, Clarksburg, MD (US); Jacquelyn S. Kubicko, Clarksburg, MD (US)

(73) Assignee: PALLAS LLC, Clarksburg, MD (US)

( * ) Notice: Subject to any disclaimer, the term of this patent is extended or adjusted under 35 U.S.C. 154(b) by 377 days.

(21) Appl. No.: 16/734,116

(22) Filed: Jan. 3, 2020

(65) Prior Publication Data

US 2020/0220248 A1 Jul. 9, 2020

Related U.S. Application Data

(60) Provisional application No. 62/788,080, filed on Jan. 3, 2019.

(51) Int. Cl.
*H01Q 1/22* (2006.01)
*H01Q 1/24* (2006.01)
(Continued)

(52) U.S. Cl.
CPC ..... *H01Q 1/2225* (2013.01); *B63C 9/0005* (2013.01); *B63C 9/20* (2013.01); *H01Q 1/24* (2013.01); *H01Q 9/0407* (2013.01); *B63B 2201/12* (2013.01); *B63B 2201/20* (2013.01); *B63C 9/082* (2013.01); *B63C 9/11* (2013.01); *B63C 9/13* (2013.01); *B63C 2009/0017* (2013.01)

(58) Field of Classification Search
CPC ... B63B 2201/12; B63B 2201/20; B63C 9/20; B63C 9/0005; B63C 2009/0017; B63C 9/11; B63C 9/13; B63C 9/082; H01Q 1/36; H01Q 1/273; H01Q 1/2225; H01Q 1/24; H01Q 1/40; H01Q 9/0407
USPC ..... 441/80, 83, 88, 89
See application file for complete search history.

(56) References Cited

U.S. PATENT DOCUMENTS 6,439,941 B2 * 8/2002 McClure ..... B63C 9/0005 441/89
6,545,606 B2 * 4/2003 Piri ..... B63C 9/0005 340/8.1
(Continued)

FOREIGN PATENT DOCUMENTS

EP 3330910 A1 6/2018

*Primary Examiner* — Daniel V Venne

(57) ABSTRACT

An overboard tracking patch is an apparatus which increases the visibility and tracking capabilities of Personal Flotation Devices (PFDs) for more efficient tracking of overboard individuals. In a passive embodiment, the apparatus includes an outer layer, an intermediate layer, an attachment layer, and a processor. The outer layer increases the visibility of PFDs during both daytime and nighttime conditions. The intermediate layer provides radio identification capabilities for the remote tracking of PFDs using search radars. The attachment layer enables users to attach the present invention to a PFD. The processor stores PFD information and other identification data. In a hybrid active-passive embodiment, the apparatus also comprises a thermionic layer and a power-storage layer. The thermionic layer generates power due to the heat exchange between the body of the user and the thermionic layer. The power-storage layer serves to store power generated by the thermionic layer to power up the processor.

17 Claims, 15 Drawing Sheets

(51) Int. Cl.

| | |
|---|---|
| ***H01Q 9/04*** | (2006.01) |
| ***B63C 9/00*** | (2006.01) |
| ***B63C 9/20*** | (2006.01) |
| ***B63C 9/08*** | (2006.01) |
| ***B63C 9/11*** | (2006.01) |
| ***B63C 9/13*** | (2006.01) |

(56) References Cited

U.S. PATENT DOCUMENTS

| | | | | |
|---|---|---|---|---|
| 7,854,639 | B1 | 12/2010 | Leal et al. | |
| 9,381,982 | B1 * | 7/2016 | Sumpter | G01S 19/17 |
| 9,536,215 | B2 | 1/2017 | Rehman | |
| 10,482,361 | B2 | 11/2019 | Yanson et al. | |
| 10,752,381 | B2 * | 8/2020 | Riera | B64D 11/0631 |
| 10,948,564 | B2 * | 3/2021 | Freeman | B63C 9/11 |
| 2011/0109442 | A1 | 5/2011 | Pavlov et al. | |
| 2016/0152350 | A1 | 6/2016 | Puentes et al. | |

* cited by examiner

OVERBOARD TRACKING PATCH

The current application claims a priority to the U.S. Provisional Patent application Ser. No. 62/788,080 filed on Jan. 3, 2019.

FIELD OF THE INVENTION

The present invention generally relates to systems and methods for long-range tracking and location. More specifically, the present invention provides an overboard tracking patch to locate individuals who need assistance after falling overboard in bodies of water.

BACKGROUND OF THE INVENTION

Locating individuals once separated from a marine vessel in large bodies of water is perhaps one of the greatest challenges in maritime Search and Rescue (SAR). Personal Flotation Devices (PFDs) are generally required to be carried by marine vessels with equipment specifications often regulated by a Federal Government. Most PFDs make it possible for People in the Water (PIWs) to remain afloat for extended periods of time; however, PFDs do not significantly reduce the challenges associated with locating PIWs. For example, while many PFDs are designed to provide some visibility to facilitate the tracking of PIWs, the visibility provided by currently available PFDs is limited and oftentimes useless due to many variables, such as weather, poor illumination, etc. Nowadays, various location and tracking technologies have been provided. Many technologies such as Global Positioning Systems (GPS) have been provided to allow for remote tracking of people and objects. However, implementing these technologies on PFDs is often expensive and unpractical due to the large amounts of PFDs provided on marine vessels and the extensive maintenance some of these technologies require.

An objective of the present invention is to provide a simple, inexpensive overboard tracking patch comprising a passive, long-range Radio Frequency Identification (RFID) antenna designed to transmit at various radio frequencies, either two to four Megahertz (MHz) (S-band) or eight to twelve MHz (X-band) when interrogated by a marine surface search radar meant to be attached to PFDs and Type IV throwable flotation devices. The present invention allows for easy detection of PIWs by standard marine radars. The overboard tracking patch comprises an outer layer coated in a material which fluoresces extremely brightly in Infrared (IR) light, such as Trivalent Chromium ions encased in Zinc Gallogermanate. Coast Guard (CG) helicopters already equipped with Electro-Optical Sensor Systems (ESS), could easily detect the signature emitted by the overboard tracking patch, adding to the already increased detection threshold for PIWs wearing PFDs. These PFDs additions would greatly improve the survivability of PIWs during the day and night. The present invention further makes inspections for flotation gear extremely quick and easy, as the flotation gear could be scanned while onboard vessels, from a distance, and maintenance, inspections, and expiration information for each device could be stored in a centralized database.

DETAILED DESCRIPTION OF THE INVENTION

All illustrations of the drawings are for the purpose of describing selected versions of the present invention and are not intended to limit the scope of the present invention.

The present invention provides an overboard tracking patch. The overboard tracking patch increases the visibility and tracking capabilities of Personal Flotation Devices (PFDs) for more efficient tracking of overboard individuals. In a preferred embodiment, the present invention comprises an outer layer 1, an intermediate layer 4, an attachment layer 6, and a processor 8. The outer layer 1 increases the visibility of PFDs during both daytime and nighttime conditions. The intermediate layer 4 provides radio identification capabilities for the remote tracking of PFDs using search radars. The attachment layer 6 enables users to attach the present invention to a PFD. The processor 8 manages and stores PFD information and other identification data.

Figure 1:
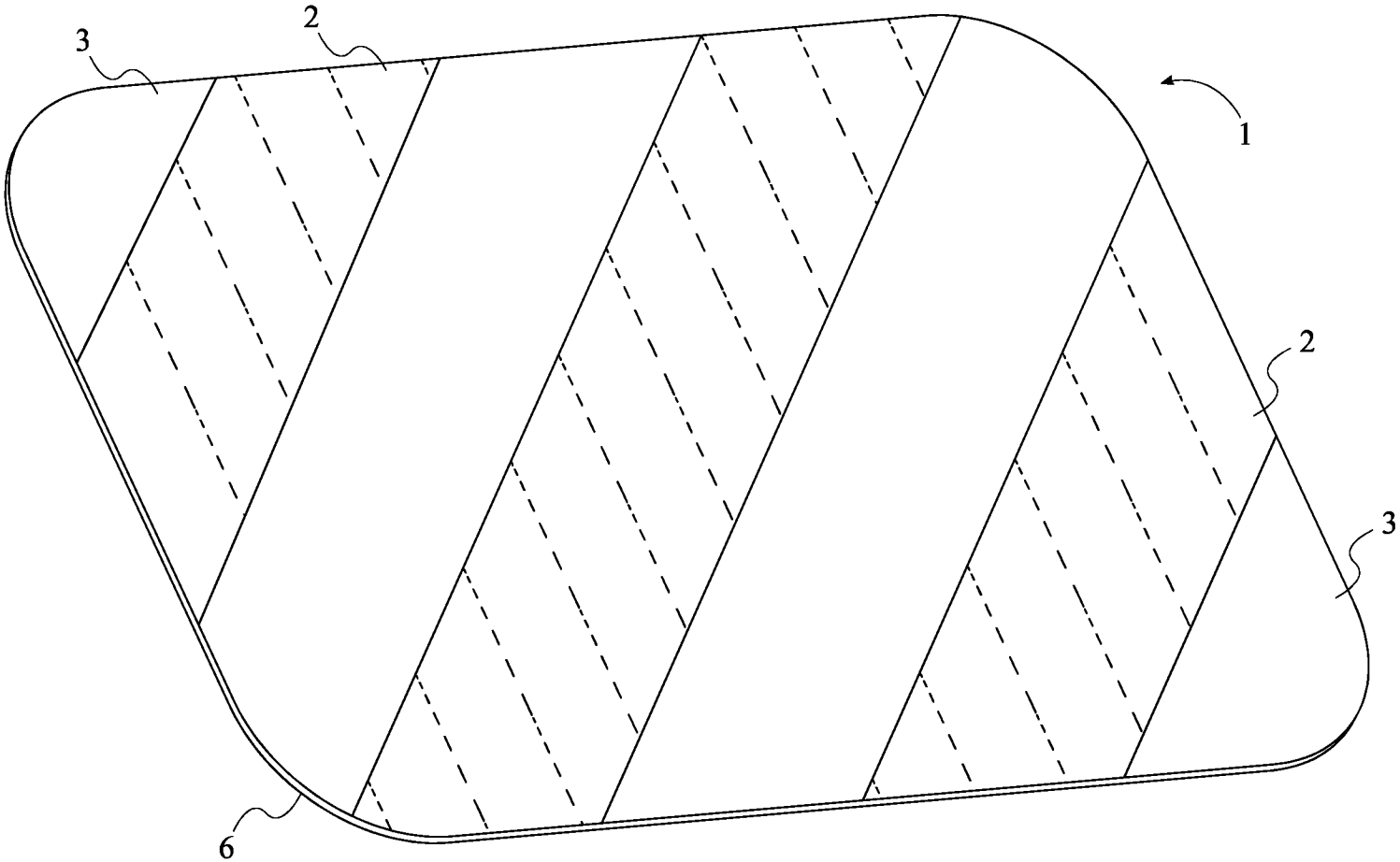
FIG. 1 is a top perspective view of the overboard tracking patch showing the outer layer.
Figure 2:
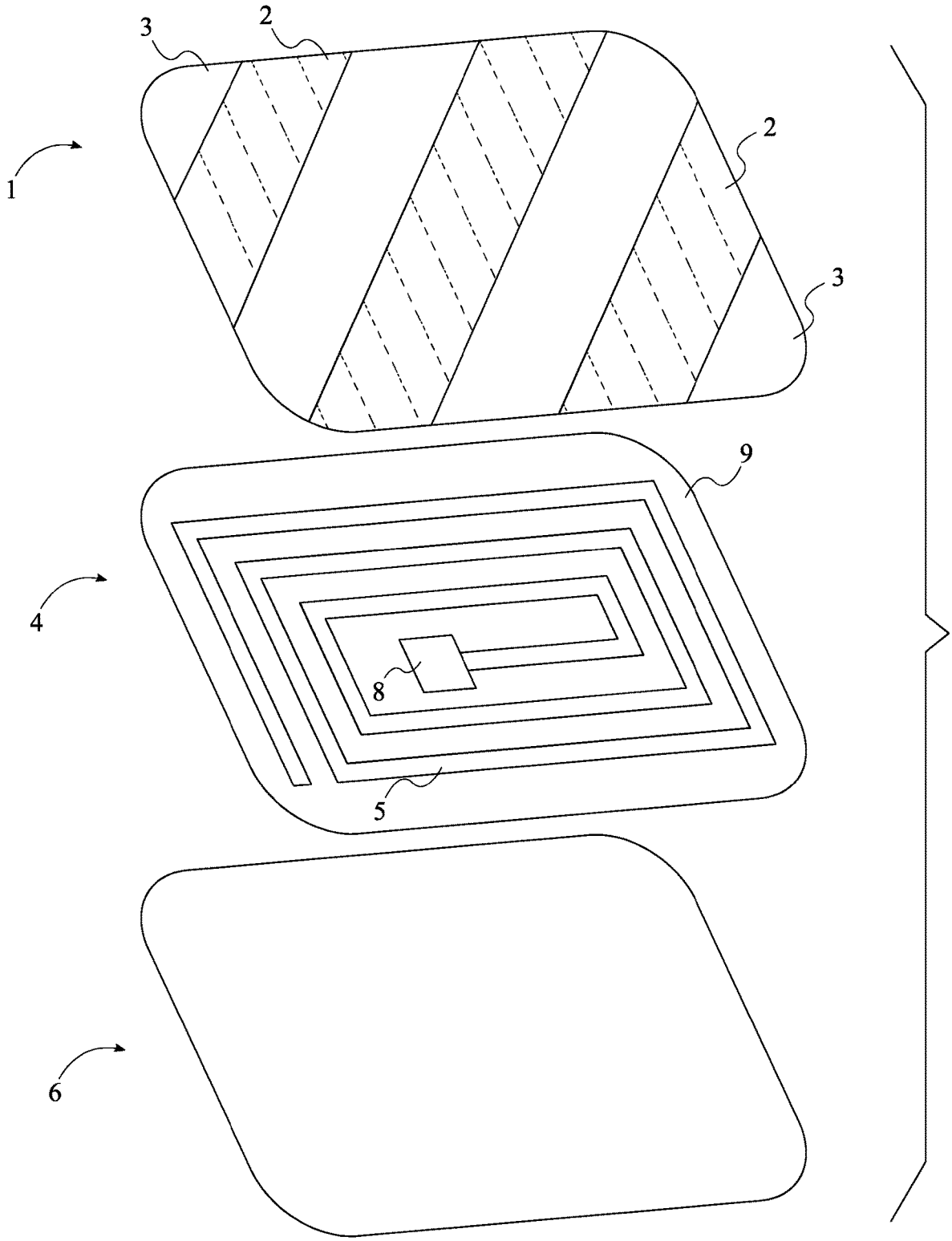
FIG. 2 is a top exploded perspective view of the passive configuration of the overboard tracking patch showing the outer layer, intermediate layer, and attachment layer.

The general configuration of the aforementioned components enable the present invention to increase the visibility of PFDs and facilitate the location of overboard individuals using search radars. As can be seen in FIG. 1-2, the outer layer 1 comprises a plurality of daytime-visibility portions 2 and a plurality of nighttime-visibility portions 3 to make the PFD easy to visually locate at different light conditions. The intermediate layer 4 comprises a Radio Frequency Identification (RFID) antenna 5 that enables the remote location of the PFD using search radars. Together, the RFID antenna 5, the plurality of daytime-visibility portions 2, and the plurality of nighttime-visibility portions 3 are used to identify the location of overboard individuals even under non-ideal conditions. The present invention can operate in a passive configuration or in a hybrid passive-active configuration. In the passive configuration, the present invention absorbs RF energy through the RFID antenna 5 for operation. In the hybrid passive-active configuration, the present invention also absorbs RF energy though the RFID antenna 5 for operation. However, in the hybrid passive-active configuration the present invention further utilizes stored power to transmit RF waves through the RFID antenna 5.

Figure 3:
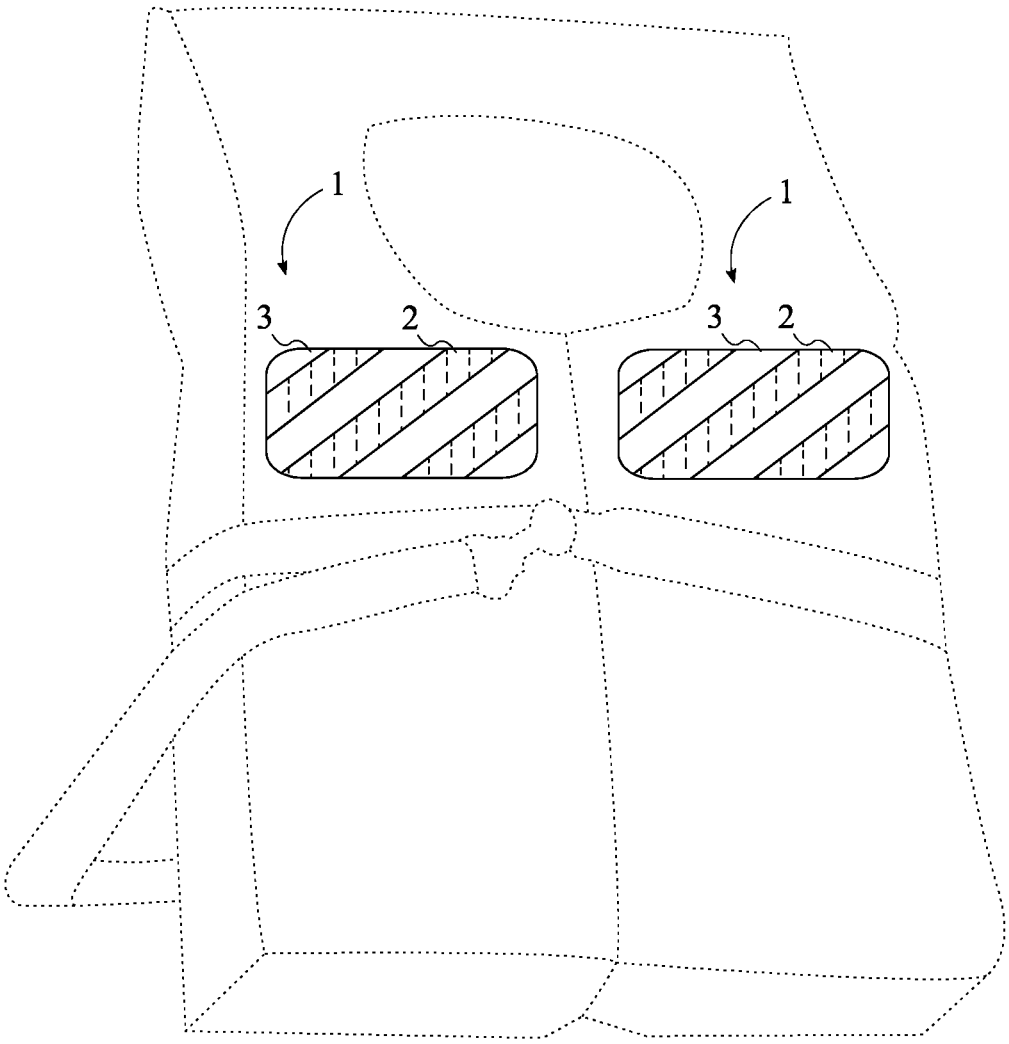
FIG. 3 is a top perspective view of the overboard tracking patch attached to a Personal Flotation Device (PFD).
Figure 4:
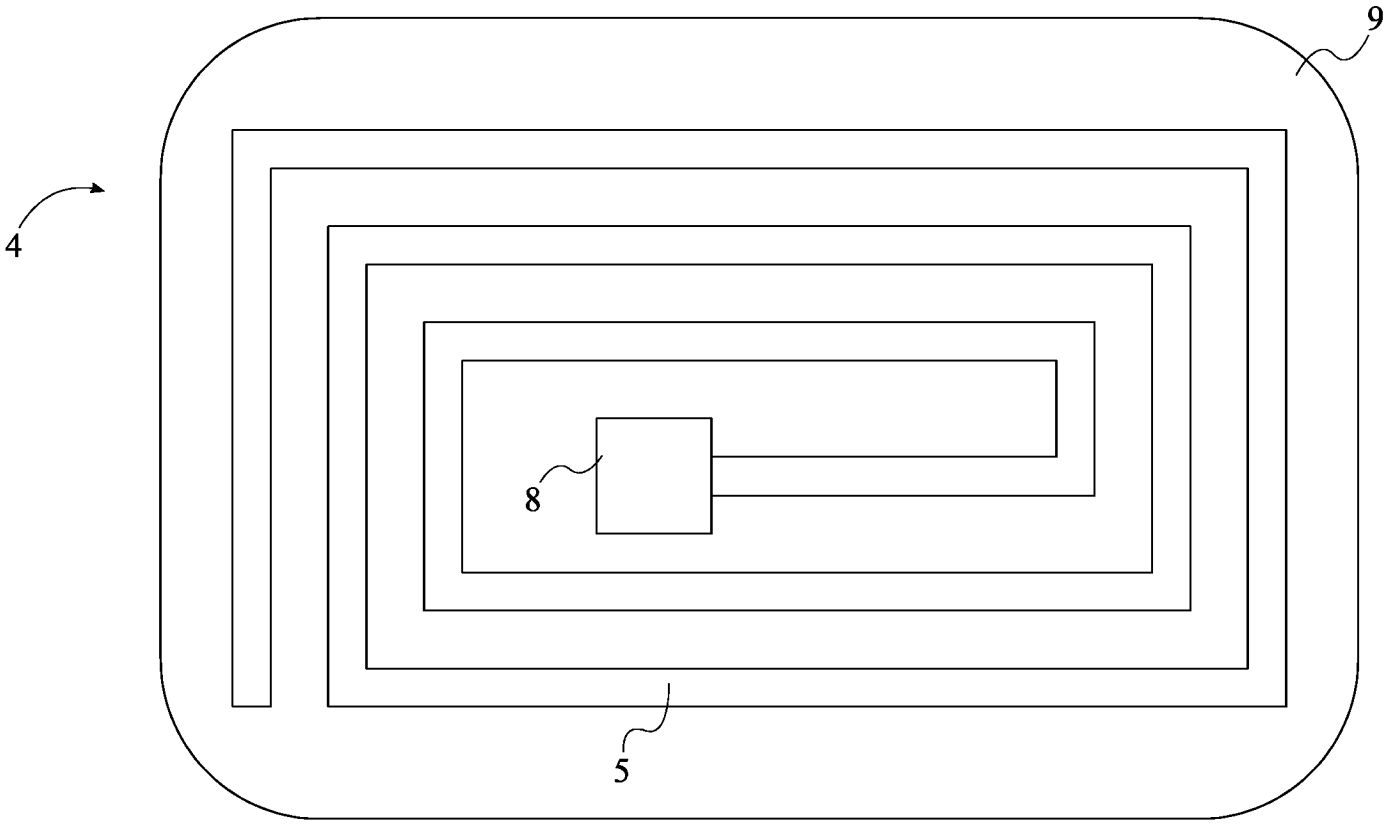
FIG. 4 is a schematic view of the intermediate layer of the overboard tracking patch showing the RFID antenna.
Figure 5:
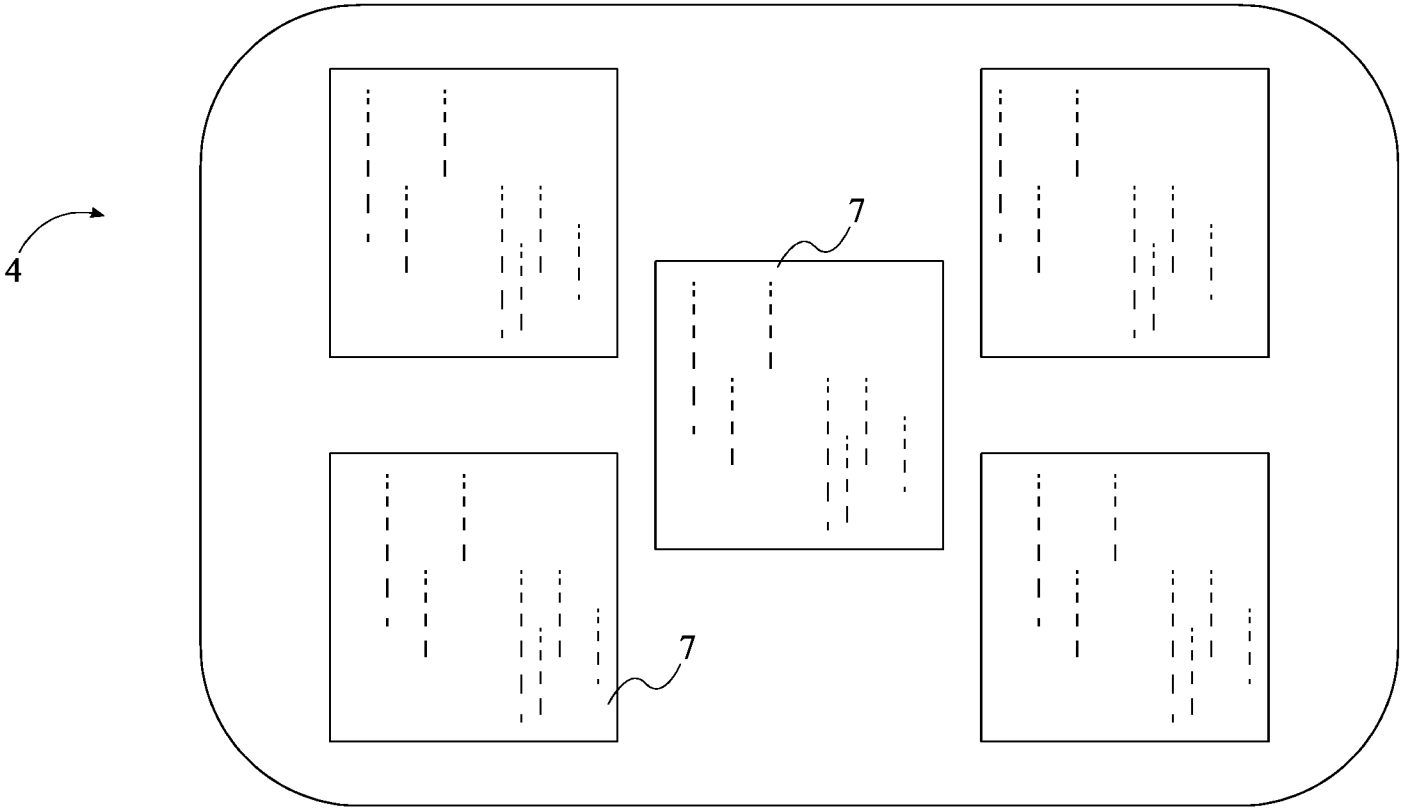
FIG. 5 is a schematic view of the rear of the attachment layer of the overboard tracking patch showing the adhesion mechanism.

As can be seen in FIG. 3, the present invention is designed to be attached to any PFD or similar survival device. The intermediate layer 4 is connected in between the outer layer 1 and the attachment layer 6 to protect the RFID antenna 5 from the external environment. As can be seen in FIG. 2, the outer layer 1 and the attachment layer 6 are coextensive with each other to fully cover the intermediate layer 4. The plurality of daytime-visibility portions 2 is interspaced amongst the plurality of nighttime-visibility portions 3 to allow for equal visibility of the PFD during daytime situations and during nighttime situations. Each of the plurality of daytime-visibility portions 2 is preferably a one-inch thick stripe. Likewise, each of the plurality of nighttime-visibility portions 3 is preferably a one-inch thick stripe. As can be seen in FIG. 4, the processor 8 is mounted in between the outer layer 1 and the attachment layer 6 for protection against the environment. The RFID antenna 5 is spanned across the intermediate layer 4 to maximize the available space on the present invention for the RFID antenna 5 to effectively receive and transmit RF signals. The RFID antenna 5 is also electronically connected to the processor 8 in order to receive and transmit data to/from the processor 8. The outer layer 1 and the attachment layer 6 is preferably made from synthetic (Nylon) materials. As can be seen in FIG. 5, in some embodiments of the present invention, the attachment layer 6 may comprise an adhesion mechanism 7 such as adhesive or fastener which enables the attachment of the present invention to a PFD. The adhesion mechanism 7 is positioned opposite to the intermediate layer 4 and is spanned across the attachment layer 6.

To increase the visibility of the present invention and the PFD, each of the plurality of daytime-visibility portions 2 is preferably made from a retroreflective material. The retroreflective material is designed for daytime visibility but can also function at nighttime by reflecting artificial or natural sources of power. Further, the plurality of nighttime-visibility portions 3 is preferably made from a trivalent chromium fluorescent material. The trivalent chromium fluorescent material fluoresces in the Near-Infrared (NIR) band of the electromagnetic spectrum, making the present invention highly visible at night to individuals using electro-optical devices tuned to detect NIR radiation. The trivalent chromium fluorescent material is enhanced using activated zinc gallogermanate powder and divalent calcium doping to absorb electromagnetic radiation in the visible and Ultraviolet (UV) band. The trivalent chromium fluorescent material is also able to emit energy in the NIR band for 360 hours after a single minute exposure to sunlight. The trivalent chromium fluorescent material has been tested with submersion in freshwater, saltwater, and even in a corrosive Bleach solution for three months with no observable decrease in performance. Coast Guard (CG) aviation assets and many land assets have night vision and/or IR sensing devices such as the FLIR Star SAFIRE 380-HD device. The FLIR Star device is capable of sensing NIR radiation, facilitating the location of individuals wearing a PFD with the present invention. In a scenario where a person falls overboard, the trivalent chromium fluorescent material provided on the present invention will automatically fluoresce in the NIR spectra, making the individual wearing the PFD easy to detect using FLIR optical systems currently in use by the CG.

In addition to increasing the visibility of PFDs, the RFID capabilities of the present invention increase the effectiveness of search and rescue operations. As can be seen in FIG. 4, the present invention may further comprise a sensing film 9 to increase the sensitivity of the RFID antenna 5. The sensing film 9 is spanned across the RFID antenna 5 and is positioned in between the intermediate layer 4 and the outer layer 1 to increase the detection of frequency changes by the RFID antenna 5. Furthermore, the RFID antenna 5 can be configured to operate under various frequencies. The RFID antenna 5 is configured to receive an RF wave selected from the bandwidth consisting of 406 MHz, X-band, S-band, and combinations thereof. In addition, the RFID antenna 5 is configured to transmit an RF wave selected from the bandwidth consisting of 406 MHz, X-band, S-band, and combinations thereof. As can be seen in FIG. 2, to further make the present invention waterproof, the processor 8 is centrally mounted onto the intermediate layer 4.

Figure 6:
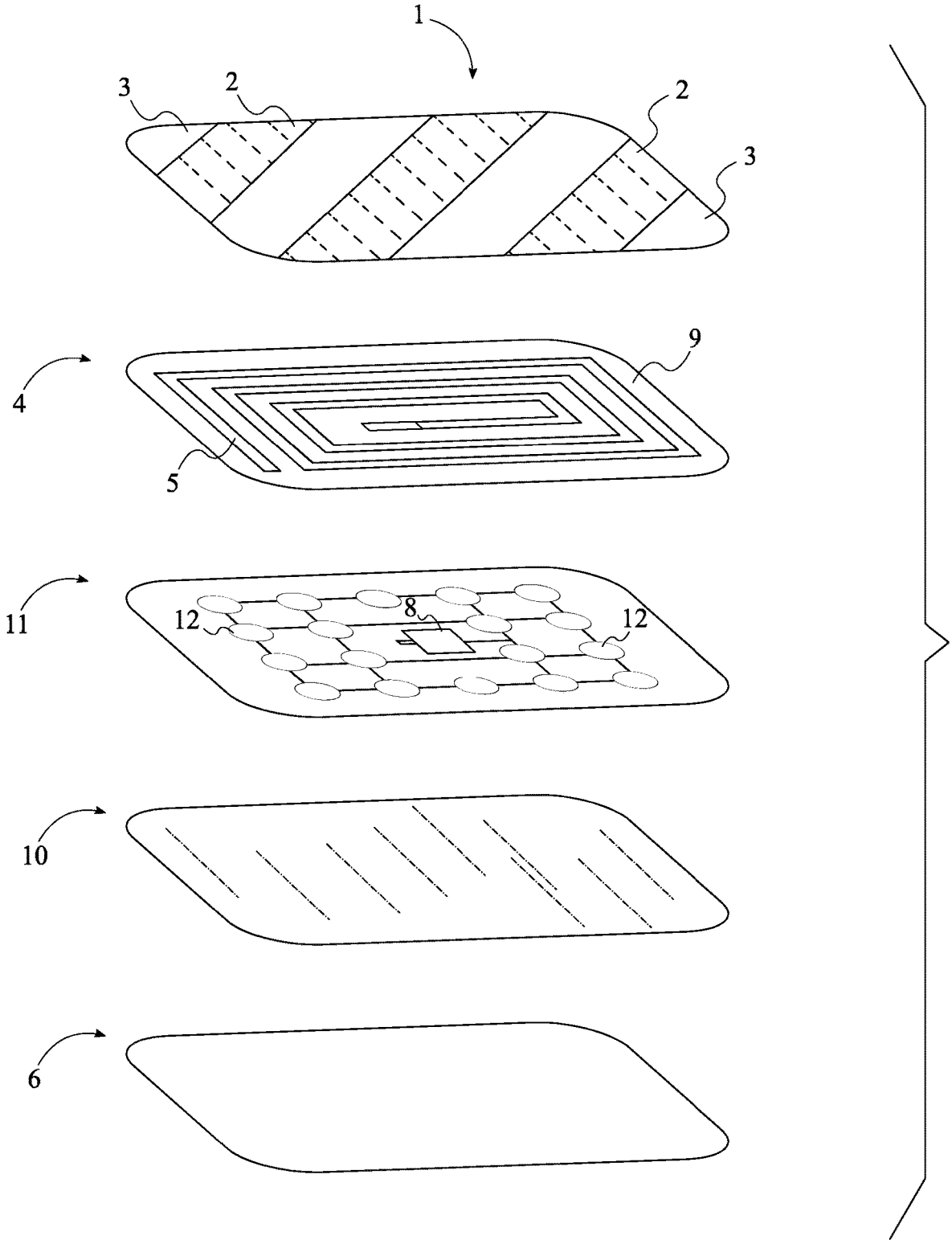
FIG. 6 is a top exploded perspective view of the hybrid passive-active configuration of the overboard tracking patch showing the thermionic layer and power-storage layer in between the attachment layer and the intermediate layer.
Figure 7:
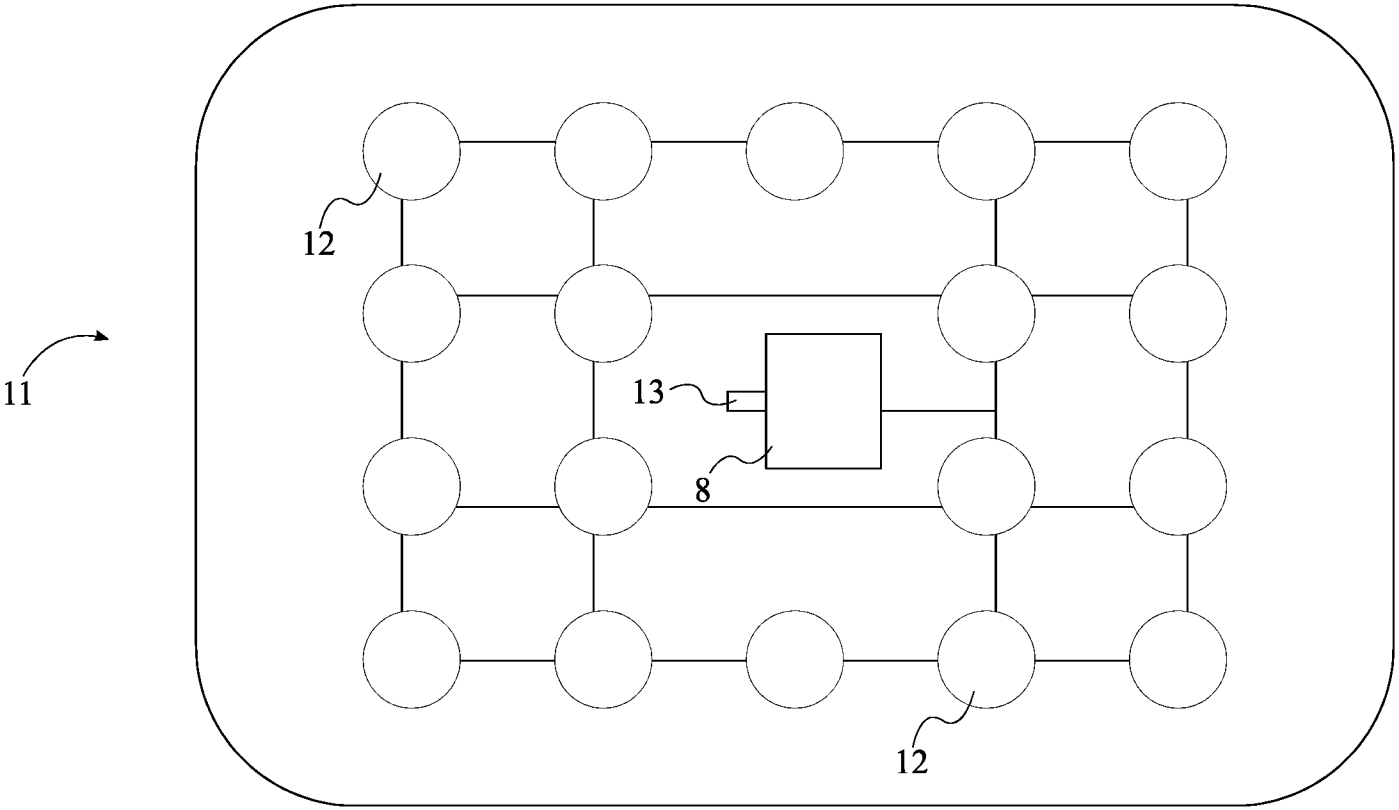
FIG. 7 is a schematic view of the power-storage layer of the overboard tracking patch showing the plurality of cell batteries.

In the hybrid passive-active configuration, the present invention is designed to self-power without wired connection to an external source of power. As can be seen in FIG. 6, the present invention may further comprise a thermionic layer 10 and a power-storage layer 11. The thermionic layer 10 generates power from the temperature differential between the thermionic layer 10 and external surroundings. The power-storage layer 11 stores the power generated from the thermionic layer 10. The thermionic layer 10 and the power-storage layer 11 further reduces the need of interaction with the user, so the present invention can autonomously operate without the user noticing, like in the passive configuration. The thermionic layer 10 is positioned adjacent to the attachment layer 6 to facilitate the heat exchange between the thermionic layer 10 and the body of the user. The power-storage layer 11 is positioned adjacent to the intermediate layer 4. Further, the thermionic layer 10 and the power-storage layer 11 are connected in between the intermediate layer 4 and the attachment layer 6 to prevent interference with the operation of the RFID antenna 5. The power-storage layer 11 is electrically connected to the processor 8 and the thermionic layer 10, so the thermionic layer 10 can charge the power-storage layer 11 in order to power up the processor 8.

Figure 8:
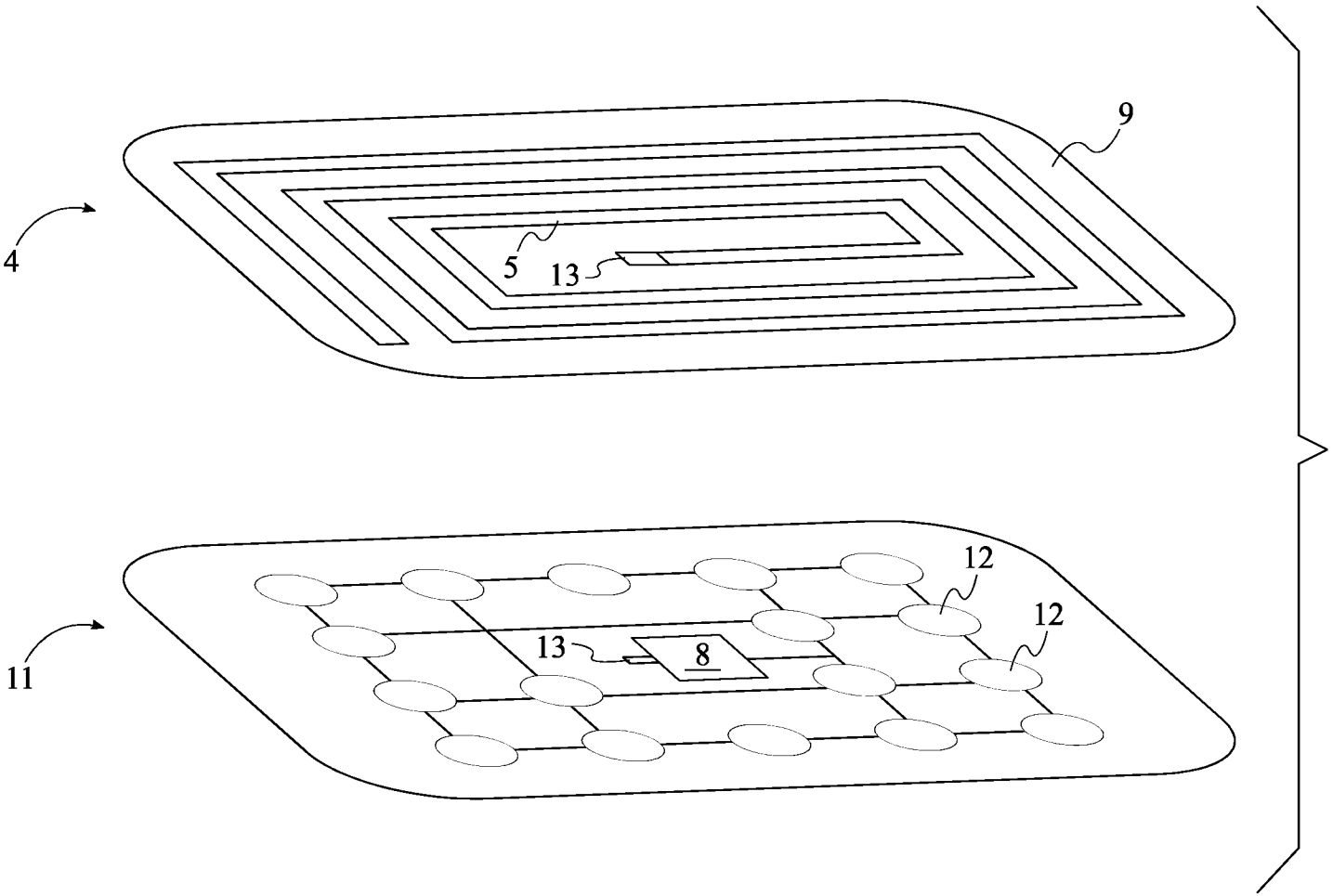
FIG. 8 is a top exploded perspective view of the intermediate layer and the power-storage layer of the overboard tracking patch showing the electronic connector.
Figure 9:
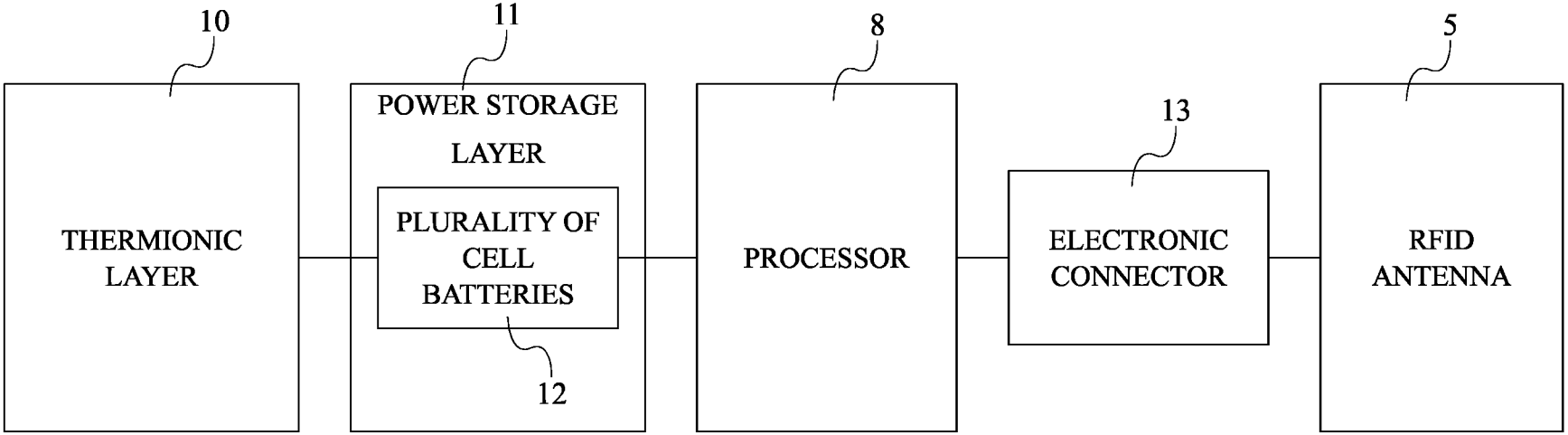
FIG. 9 is schematic view showing the electronic connections of the hybrid passive-active configuration of the overboard tracking patch.

In some embodiments of the hybrid passive-active configuration, the power-storage layer 11 may comprise a plurality of cell batteries 12 to store power generated by the thermionic layer 10. As can be seen in FIG. 2, each of the plurality of cell batteries 12 is positioned parallel to the power-storage layer 11 in order to maintain the compact design of the present invention. The plurality of cell batteries 12 is distributed across the power-storage layer 11 for space efficiency and to reduce the overall thickness of the present invention. Further, in some embodiments, the processor 8 is mounted onto the power-storage layer 11. As can be seen in FIGS. 8 and 9, the present invention may further comprise an electronic connector 13. The RFID antenna 5 is electronically connected to the processor 8 by the electronic connector 13. The addition of a plurality of cell batteries 12 and the electronic connector 13 can facilitate the use of the present invention to verify that a vessel is carrying the proper number of PFDs onboard, without even having to board the vessel. Furthermore, ID number of the PFD can be tracked in order to determine CG inspection, manufacturing information, and characteristics (i.e. infant life jackets, or cold weather survival rating for immersion suits) in the same way.

Figure 10:
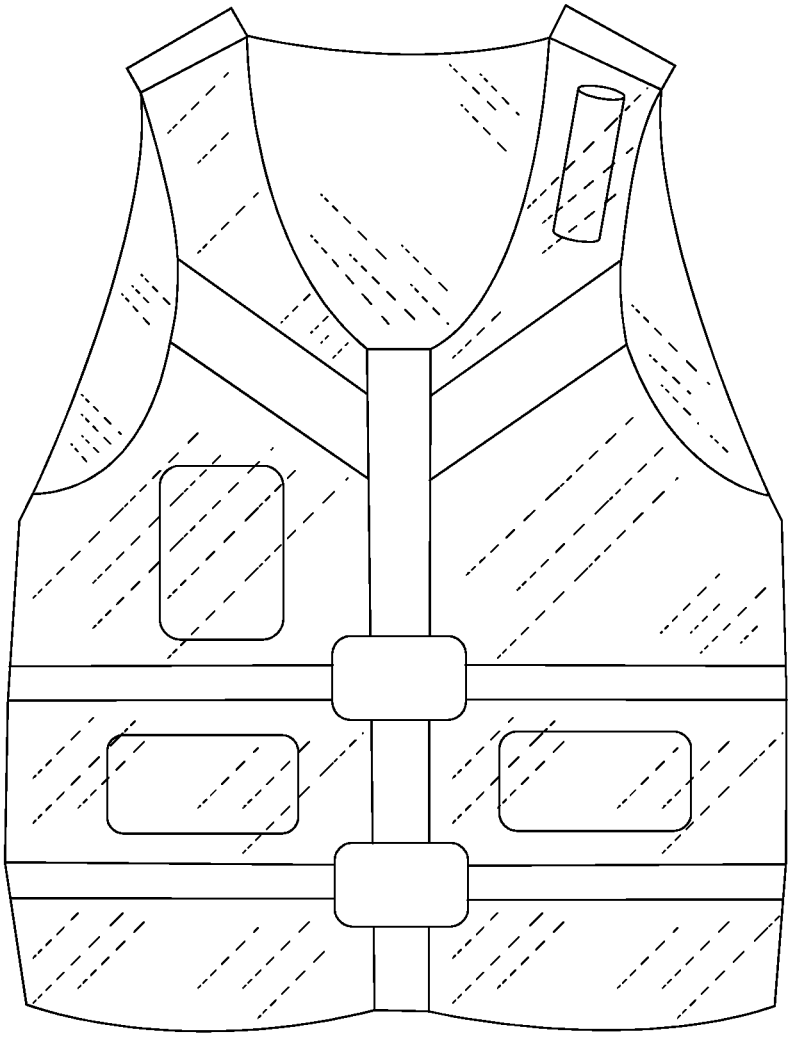
FIG. 10 is a front view showing the overboard tracking device integrated into a PFD vest.
Figure 11:
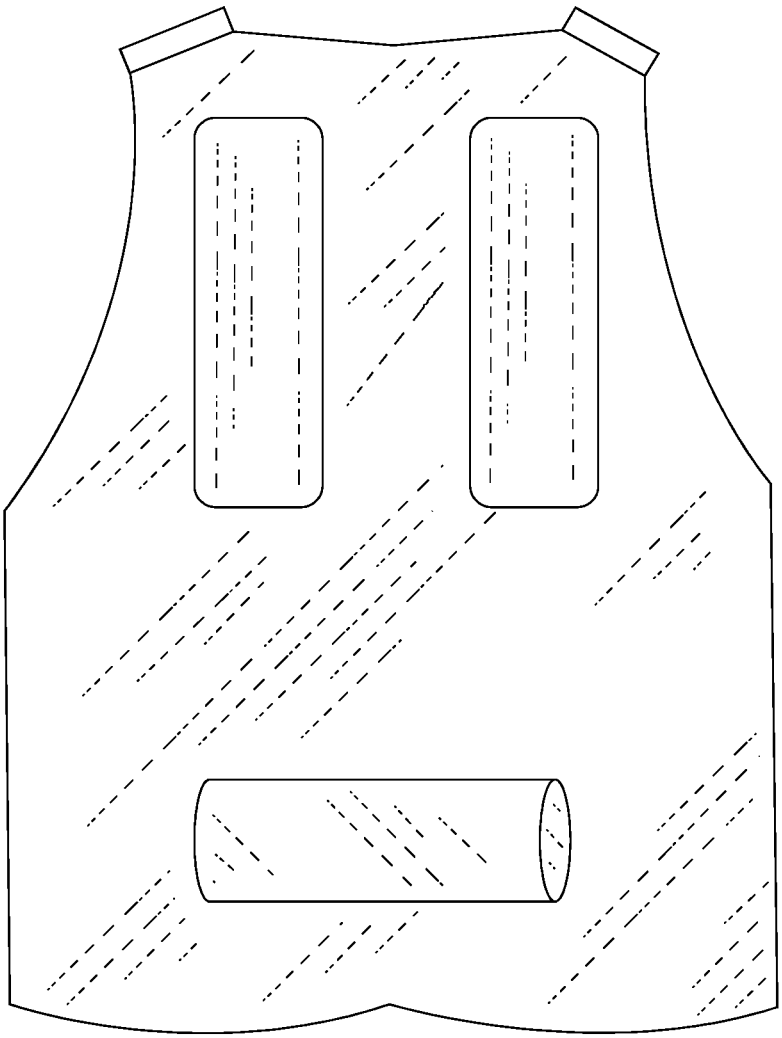
FIG. 11 is a back view showing the overboard tracking device integrated into a PFD vest.
Figure 12:
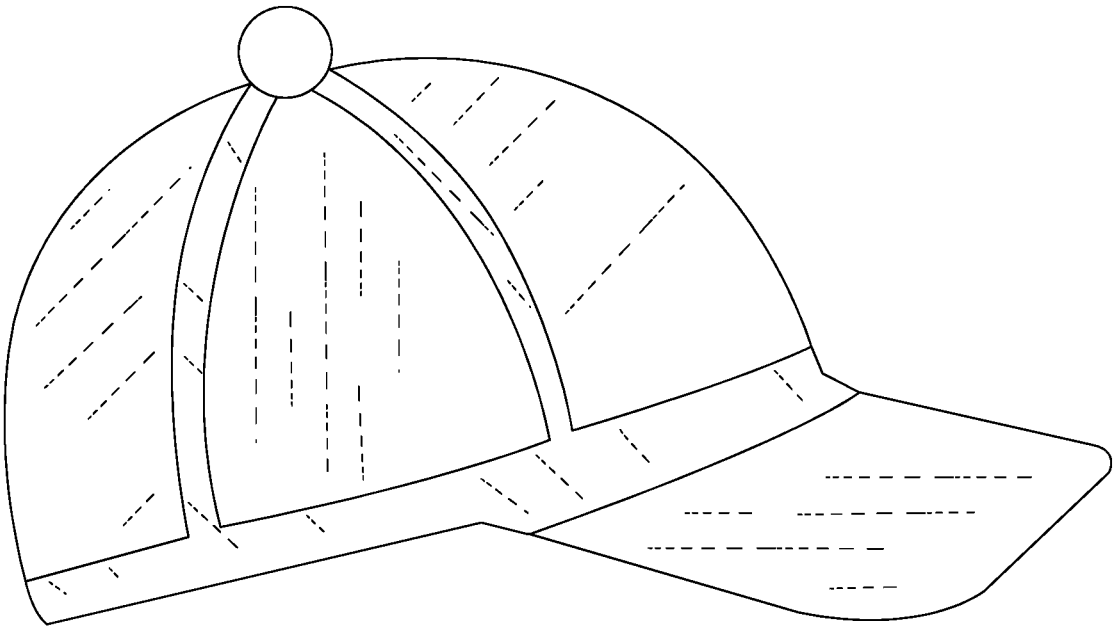
FIG. 12 is a side view showing the overboard tracking device integrated into a PFD headgear.
Figure 13:
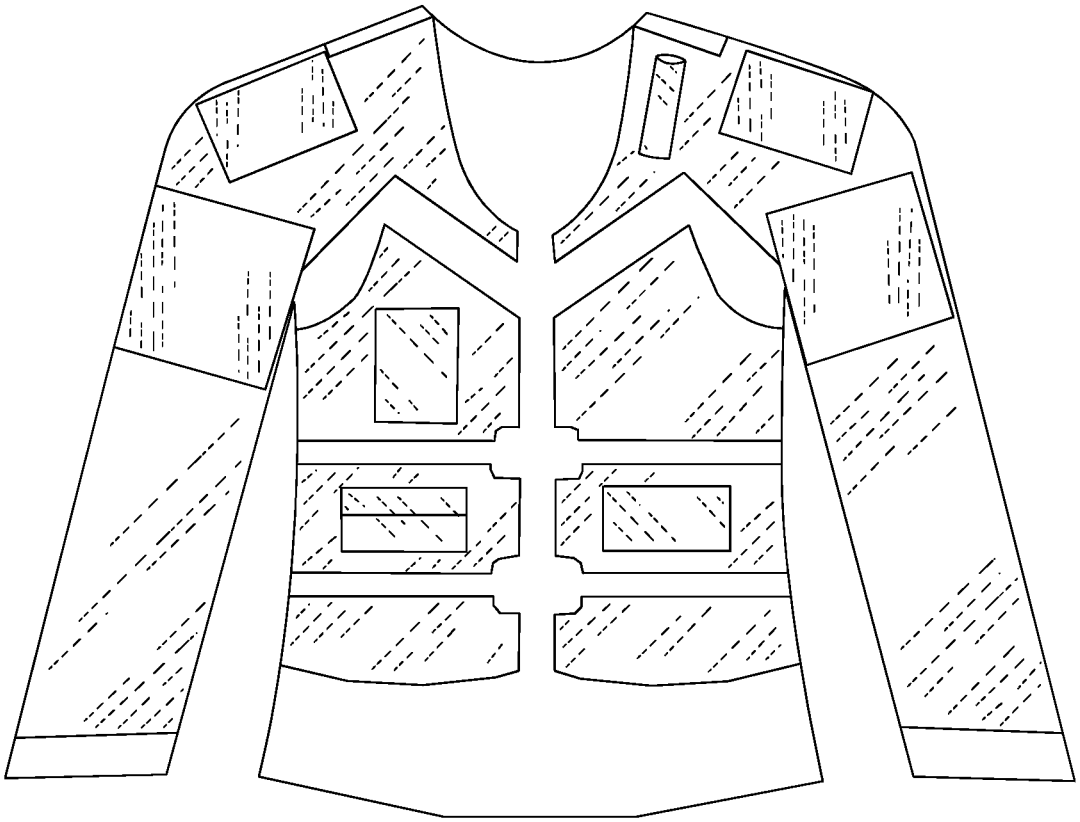
FIG. 13 is a front view showing the overboard tracking device integrated into a PFD jacket.
Figure 14:
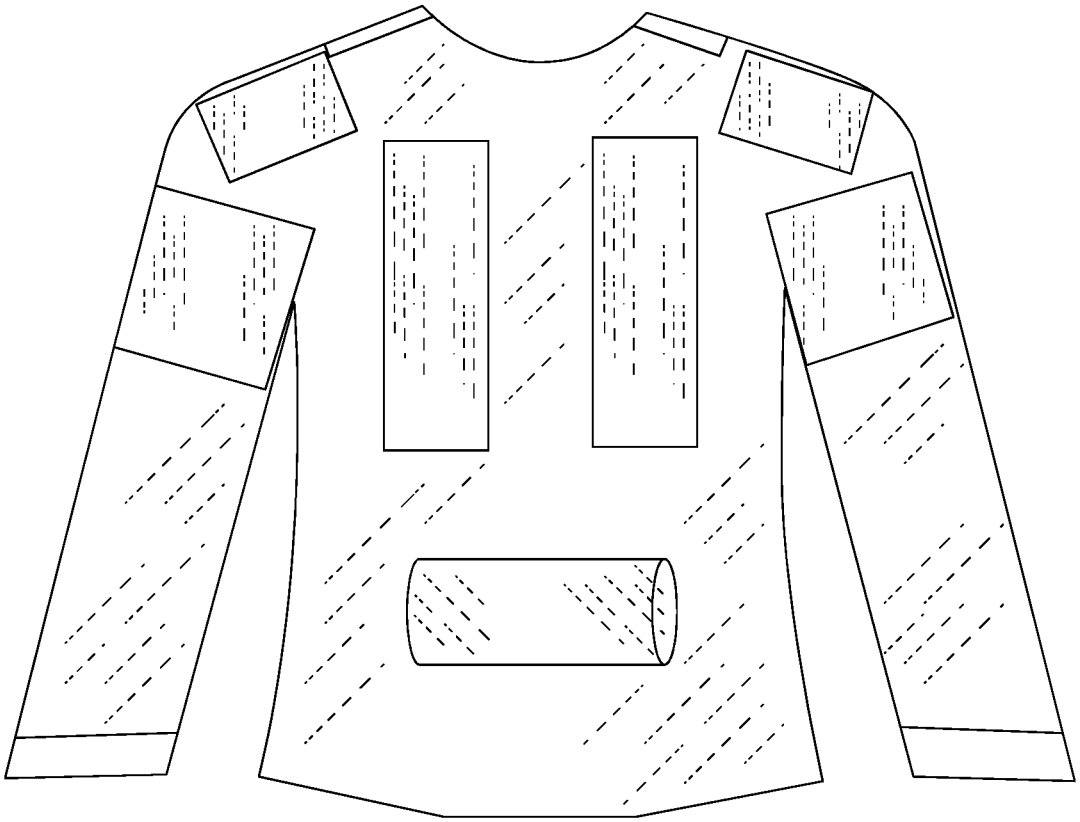
FIG. 14 is a rear view showing the overboard tracking device integrated into a PFD jacket.
Figure 15:
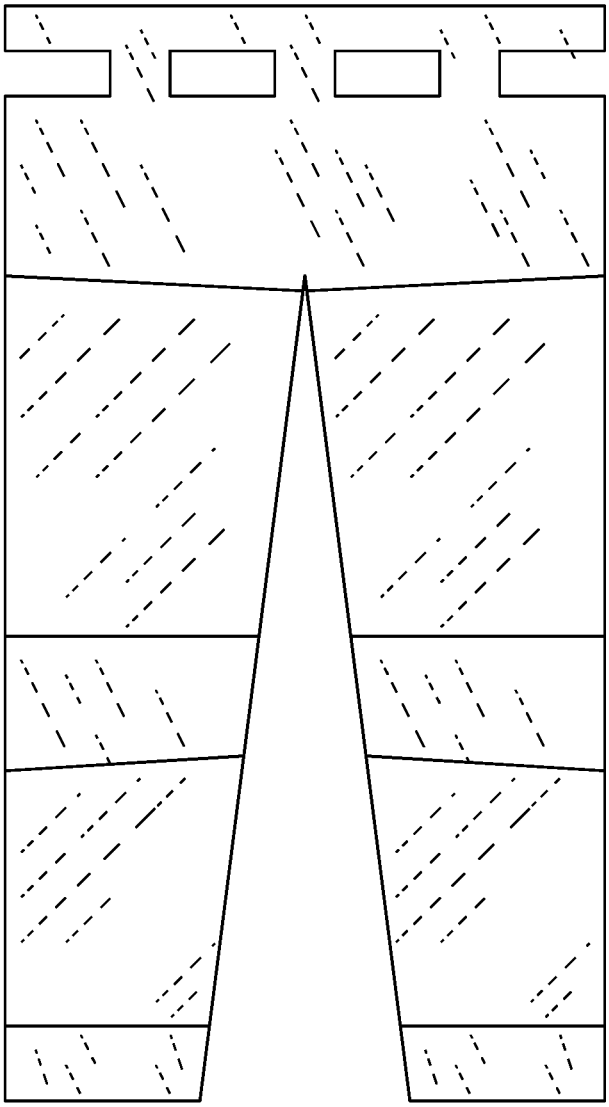
FIG. 15 is a front view showing the overboard tracking device integrated into PFD pants.

In further embodiments, the present invention can be integrated on PFDs or in the body of a garment. As can be seen in FIGS. 10 and 11, the present invention can be integrated on a PFD, such as a life vest. The PFD can be structured with a plurality of layers comprising an outer layer, an antenna layer, a power-storage layer, a thermionic layer, a flotation layer, and a thermal layer. The thermal layer can be an activatable heat mechanism comprising a plurality of chemical substances that initially are separately provided. The activatable heat mechanism can be engaged to mix the plurality of chemical substances to cause an exothermic reaction. The flotation layer may comprise a plurality of flotation devices which maintain the user afloat in a body of water. The thermionic layer generates power from the temperature differential between the thermionic layer and its surroundings. The power-storage layer is electrically connected to the thermionic layer to store the power generated from the thermionic layer. The antenna layer may comprise an antenna and a processor to transmit radio signals to help track the user using search radars. The outer layer comprises a plurality of NIR stripes and a plurality of retro-reflective materials for daytime and nighttime visibility.

The PFD with the present invention integrated on may further comprise a plurality of survival gadgets. As can be seen in FIGS. 10 and 11, the plurality of survival gadgets may comprise a mobile device hub, at least one survival kit, and a pyrotechnics kit. The mobile device hub may comprise a storage compartment to receive at least one mobile device, a docket, a controller, and a plurality of body sensors. The docket is electronically connected to the controller to connect the mobile device to the controller. The docket may also wirelessly connect the mobile device to the controller utilizing short-distance radio technologies. The plurality of body sensors is distributed about the PFD to measure various body variables such as body temperature or blood pressure. The pyrotechnics kit can be a standard pyro kit which can be used to generate a pyro signal. The survival kit can include various tools such as first aid tools to help the user attend injuries. In addition, the PFD can further comprise a plurality of LED strobe lights and a plurality of NIR strobe lights which generate a visual signal to help locate the user wearing the PFD. To facilitate the operation of the plurality of strobe lights, a plurality of solar panels is further externally integrated into the body of the PFD to generate enough power to power up the plurality of strobe lights. The plurality of solar panels can also provide power to facilitate the operation of the electronic components of the present invention. Finally, the PFD may comprise a baton signal antenna and the balloon signal antenna to transmit higher radio frequencies. The baton signal antenna and the balloon signal antenna are each electronically connected to the antenna layer. Furthermore, the PFD garment can be designed for specific applications, such as military applications, in the form of multipiece garments. As can be seen in FIG. 12 through 15, the multipiece garment may comprise headgear, an upper-body portion, and a lower-body portion. The plurality of layers is integrated into the headgear as well as the plurality of strobe lights and plurality of solar panels. The upper-body portion may comprise a similar structure to the PFD garment. In further embodiments, the present invention can be structured to meet different requirements depending on the application of the PFD garment. The present invention can also be integrated on different objects which can be available to users in maritime applications.

The present invention may further comprise an overboard alarm system. The overboard alarm system may comprise a vessel transmitter and an alarm module. The vessel transmitter can be located on a vessel or a transportation vehicle to passively track the location of the user while the user is with the vessel. The alarm module is integrated into the present invention to generate an alarm signal once the user falls overboard. The alarm module may utilize a plurality of movement tracking devices, such as an accelerometer or gyroscope, which monitor the movement of the user. The plurality of movement tracking devices may generate the alarm signal once a preset threshold is met, such as immediate acceleration or change of elevation relative to the position of the vessel transmitter. The vessel transmitter is wirelessly connected to the alarm module so when the vessel transmitter receives the alarm signal from the alarm module, an overboard notification is generated. The overboard notification is transmitted to appropriate users through multiple communication channels. In further embodiments, the alarm module may communicate with third-party systems to transmit the alarm signal through third-party communication channels.

Although the invention has been explained in relation to its preferred embodiment, it is to be understood that many other possible modifications and variations can be made without departing from the spirit and scope of the invention as hereinafter claimed.

What is claimed is:

1. An overboard tracking patch comprises:
- an outer layer;
- an intermediate layer;
- an attachment layer;
- a processor;
- the outer layer comprising a plurality of daytime-visibility portions and a plurality of nighttime-visibility portions;
- the intermediate layer comprising a radio frequency identification (RFID) antenna;
- the intermediate layer being connected in between the outer layer and the attachment layer;
- the outer layer and the attachment layer being coextensive with each other;
- the plurality of daytime-visibility portions being interspaced amongst the plurality of nighttime-visibility portions;
- the processor being mounted in between the outer layer and the attachment layer;
- the RFID antenna being spanned across the intermediate layer; and,
- the RFID antenna being electronically connected to the processor.

2. The overboard tracking patch as claimed in claim 1, wherein each of the plurality of daytime-visibility portions is made of a retroreflective material.

3. The overboard tracking patch as claimed in claim 1, wherein each of the plurality of nighttime-visibility portion is made of a trivalent chromium fluorescent material.

4. The overboard tracking patch as claimed in claim 1 comprises:
- a sensing film;
- the sensing film being spanned across the RFID antenna; and,
- the sensing film being positioned in between the intermediate layer and the outer layer.

5. The overboard tracking patch as claimed in claim 1, wherein the RFID antenna is configured to receive an RF wave selected from the bandwidth consisting of 406 MHz, X-band, S-band, and combinations thereof.

6. The overboard tracking patch as claimed in claim 1, wherein the RFID antenna is configured to transmit an RF wave selected from the bandwidth consisting of 406 MHz, X-band, S-band, and combinations thereof.

7. The overboard tracking patch as claimed in claim 1 comprises:

the processor being centrally mounted onto the intermediate layer.

8. The overboard tracking patch as claimed in claim 1 comprises:

a thermionic layer;

a power-storage layer;

the thermionic layer being positioned adjacent to the attachment layer;

the power-storage layer being positioned adjacent to the intermediate layer;

the thermionic layer and the power-storage layer being connected in between the intermediate layer and the attachment layer; and, the power-storage layer being electrically connected to the processor and the thermionic layer.

9. The overboard tracking patch as claimed in claim 8 comprises:

the power-storage layer comprises a plurality of cell batteries;

each of the plurality of cell batteries being positioned parallel to the power-storage layer; and, the plurality of cell batteries being distributed across the power-storage layer.

10. The overboard tracking patch as claimed in claim 8 comprises:

an electronic connector;

the processor being mounted onto the power-storage layer; and, the RFID antenna being electronically connected to the processor by the electronic connector.

11. An overboard tracking patch comprises:

an outer layer;

an intermediate layer;

an attachment layer;

a processor;

the outer layer comprising a plurality of daytime-visibility portions and a plurality of nighttime-visibility portions;

the intermediate layer comprising a radio frequency identification (RFID) antenna;

the intermediate layer being connected in between the outer layer and the attachment layer;

the outer layer and the attachment layer being coextensive with each other;

the plurality of daytime-visibility portions being interspaced amongst the plurality of nighttime-visibility portions;

the processor being mounted in between the outer layer and the attachment layer;

the RFID antenna being spanned across the intermediate layer;

the RFID antenna being electronically connected to the processor;

each of the plurality of daytime-visibility portions is made of a retroreflective material; and, each of the plurality of nighttime-visibility portion is made of a trivalent chromium fluorescent material.

12. The overboard tracking patch as claimed in claim 11 comprises:

a sensing film;

the sensing film being spanned across the RFID antenna;

the sensing film being positioned in between the intermediate layer and the outer layer; and, the processor being centrally mounted onto the intermediate layer.

13. The overboard tracking patch as claimed in claim 11, wherein the RFID antenna is configured to receive and transmit an RF wave selected from the bandwidth consisting of 406 MHz, X-band, S-band, and combinations thereof.

14. The overboard tracking patch as claimed in claim 11 comprises:

a thermionic layer;

a power-storage layer;

an electronic connector;

the power-storage layer comprises a plurality of cell batteries;

the thermionic layer being positioned adjacent to the attachment layer;

the power-storage layer being positioned adjacent to the intermediate layer;

the thermionic layer and the power-storage layer being connected in between the intermediate layer and the attachment layer;

the power-storage layer being electrically connected to the processor and the thermionic layer;

each of the plurality of cell batteries being positioned parallel to the power-storage layer;

the plurality of cell batteries being distributed across the power-storage layer;

the processor being mounted onto the power-storage layer; and, the RFID antenna being electronically connected to the processor by the electronic connector.

15. An overboard tracking patch comprises:

an outer layer;

an intermediate layer;

an attachment layer;

a processor;

a sensing film;

the outer layer comprising a plurality of daytime-visibility portions and a plurality of nighttime-visibility portions;

the intermediate layer comprising a radio frequency identification (RFID) antenna;

the intermediate layer being connected in between the outer layer and the attachment layer;

the outer layer and the attachment layer being coextensive with each other;

the plurality of daytime-visibility portions being interspaced amongst the plurality of nighttime-visibility portions;

the processor being mounted in between the outer layer and the attachment layer;

the RFID antenna being spanned across the intermediate layer;

the RFID antenna being electronically connected to the processor;

each of the plurality of daytime-visibility portions is made of a retroreflective material;

each of the plurality of nighttime-visibility portion is made of a trivalent chromium fluorescent material;

the sensing film being spanned across the RFID antenna;

the sensing film being positioned in between the intermediate layer and the outer layer; and, the processor being centrally mounted onto the intermediate layer.

16. The overboard tracking patch as claimed in claim 15, wherein the RFID antenna is configured to receive and transmit an RF wave selected from the bandwidth consisting of 406 MHz, X-band, S-band, and combinations thereof.

17. The overboard tracking patch as claimed in claim 15 comprises:

a thermionic layer;

a power-storage layer;

an electronic connector;

the power-storage layer comprises a plurality of cell batteries;

the thermionic layer being positioned adjacent to the attachment layer;

the power-storage layer being positioned adjacent to the intermediate layer;

the thermionic layer and the power-storage layer being connected in between the intermediate layer and the attachment layer;

the power-storage layer being electrically connected to the processor and the thermionic layer;

each of the plurality of cell batteries being positioned parallel to the power-storage layer;

the plurality of cell batteries being distributed across the power-storage layer;

the processor being mounted onto the power-storage layer; and, the RFID antenna being electronically connected to the processor by the electronic connector.

* * * * *